US005383744A

United States Patent [19]

Hendershot

[11] Patent Number: 5,383,744

[45] Date of Patent: Jan. 24, 1995

[54] SUBIRRIGATION SYSTEM AND METHOD

[76] Inventor: Robert V. Hendershot, 3450 Hidden Hills Dr., Santa Rosa, Calif. 95404

[21] Appl. No.: 113,990

[22] Filed: Aug. 30, 1993

[51] Int. Cl.[6] ..... E02B 13/00

[52] U.S. Cl. ..... 405/36; 52/DIG. 9; 405/16; 405/21; 405/258

[58] Field of Search ..... 405/36, 38; 47/DIG. 13, 47/79, 32; 52/DIG. 9

[56] References Cited

U.S. PATENT DOCUMENTS

| | | | |
|---|---|---|---|
| 774,988 | 11/1904 | Maurer | 47/79 |
| 1,439,973 | 12/1922 | Olson | 405/36 |
| 2,105,800 | 1/1938 | Watkins | 47/48.5 X |
| 4,986,699 | 1/1991 | Bohnhoff | 405/36 X |
| 5,267,662 | 12/1993 | Hayes | 52/DIG. 9 |

FOREIGN PATENT DOCUMENTS

| | | | |
|---|---|---|---|
| 2705375 | 6/1978 | Germany | 47/83 |
| 3718288 | 12/1988 | Germany | 47/DIG. 13 |
| 3829615 | 3/1990 | Germany | 52/DIG. 9 |

*Primary Examiner*—Dennis L. Taylor
*Attorney, Agent, or Firm*—McCaleb, Lucas & Brugman

[57] ABSTRACT

An underground agricultural irrigation system in which annular semi-cylindrical or concave-convex water reservoirs, formed by splitting used or abandoned vehicle tire casings in half, are buried concave side up at appropriate subsurface depths to trap and retain moisture used to nurture overgrowing plant roots. In a modified version concave moisture retaining caps are mounted over the open centers of each reservoir to increase moisture retention capacity.

6 Claims, 3 Drawing Sheets

SUBIRRIGATION SYSTEM AND METHOD

This invention is related to agricultural plant and turf irrigation and more particularly to underground systems and methods for capturing and retaining water and moisture to promote plant growth.

In this country approximately 240 million vehicle tires are discarded annually creating an enormous waste disposal problem. Some are reclaimed or burned, others are stored above ground while still others are buried in landfills. Burning leads to air contamination. Above ground storage is unsatisfactory since the tires collect water productive of unwanted breeding grounds for vermin and insects. Landfill disposal is not acceptable since the tires are not biodegradable and are prone to collect methane gas which causes the casings to gradually float to the surface. Thus there is a growing and unpopular tire disposal problem.

In a similar vein, there are large areas of land in this country which are agriculturally unproductive or marginally so due to lack of water or inability of the soil to retain moisture sufficient for crop production.

In addition, inasmuch as some water applied by rainfall or sprinkler irrigation may percolate beyond the root zone of the plants, it is thereby wasted or lost to plant production.

The present invention is directed to the solution of the above outlined problems by converting used tire casings to a unique underground water retention and irrigation system whereby water otherwise wasted by over irrigation or excessive rainfall will be captured and retained so that marginally productive, arid land or land having poor moisture retention characteristics may be made agriculturally productive.

BRIEF DESCRIPTION OF THE INVENTION

In brief this invention comprises one or more moisture reservoirs or traps of concave-convex annular structure operably buried in soil at subsurface levels with the concave side thereof facing upwardly for capturing and retaining water and moisture; the same being located preferably beneath the root zone of individual or multiple plantings. When used with multiple plantings, such as turf, grain or other acreage crops and plant life, plural such annulai preferably are positioned in peripheral adjacency to form one or more layers of reservoir traps beneath the planting surface and at a depth such that moisture trapped thereby will migrate upwardly by adhesion, osmosis and capillary action to reach the root zone of the planting without interfacing with the soil surface. In a modified form, suitable concave caps are mounted over the open centers of the annuli to increase water capturing and retention capacity.

It is a principal object of this invention to provide an improved, simplified, economical and efficient underground system and method for irrigating plants.

Another important object of this invention is to provide an irrigating system according to the previous object which employs bisected discarded vehicle tire carcasses as water retention reservoir means.

A still further object of this invention is to provide a subsurface passive agricultural irrigation system which is long lasting and requires little or no maintenance or upkeep.

A further important object of this invention is to provide an efficient subterranean agricultural irrigation system which enhances and prolongs the effects of natural rainfall or irrigation water in providing moisture to growing plant life.

Another very important object of this invention is to provide means to reduce and/or delay the frequency of required artificial irrigation resulting in water conservation.

An additional important object of this invention is to provide a method of supplying moisture to marginally productive, or arid land and land having poor water retention characteristics whereby to render the same capable of supporting plant life.

Having described this invention, the above and further objects, features and advantages thereof will be recognized by those skilled in the art from the following detailed description of preferred and modified embodiments thereof illustrated in the accompanying drawings and representing the best mode presently contemplated for enabling those skilled in the art to practice this invention.

IN THE DRAWINGS

DESCRIPTION OF THE PREFERRED EMBODIMENT

Figure 1:
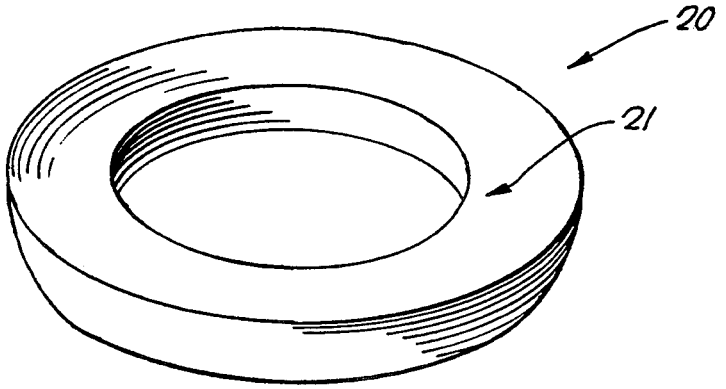
FIG. 1 is a perspective view of an annular reservoir trap of this invention.
Figure 2:
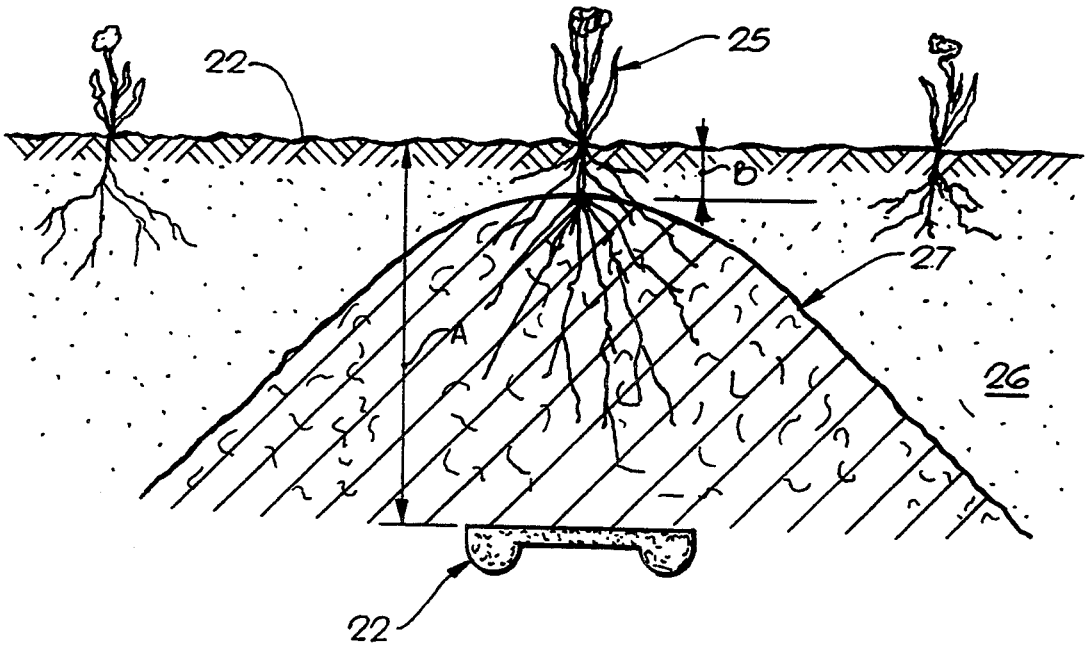
FIG. 2 is a schematic illustration of an individual reservoir trap of FIG. 1, buried underground in operative relation a growing plant.

Turning now to the features of the preferred embodiment of this invention, initial reference is made to FIGS. 1 and 2 of the drawings wherein an annular underground water reservoir or trap, according to this invention, is indicated generally at 20.

As particularly represented in FIG. 1 reservoir 20, is preferably a semi-cylindrical, concave-convex, non-degradeable annulus capable of retaining water and which preferably and conveniently may be achieved by splitting a conventional vehicle tire carcass in half along a medial plane normal to the central rotational axis of the tire. By so doing two reservoir traps 20 are formed, each with an annular semi-cylindrical or concave moisture retaining interior chamber 21. The tire halves may be scrubbed and degreased prior to embedment in the soil to avoid possible soil contamination. While such use of worn or discarded tire casings is most desirable from the standpoint of the disposal and conversion to a useful purpose of an otherwise unwanted resource, reservoirs 20 also may be produced from plastics (particularly reclaimed plastics) or other non or slowly degradable materials capable of enduring underground for extended periods.

As best shown in FIG. 2, one or more annular reservoirs 20, are adapted to buried underground with the open concave side thereof facing upwardly, so that water applied to surface 22 of the planting area will percolate downwardly through the soil to be captured and trapped within chamber 21 of the buried reservoir. It will be understood that the open interior of the chamber 21 is filled with sand or other soil once the reservoir is in place and covered with earth. If desired, fertilizer also may be placed in the open chamber 21 before covering the reservoir. However, such fertilizer will soon be leached out into the soil after time and thus its presence in the reservoir is, at best, temporary. Surface applied fertilizer, however, may be conserved in the same manner as water is. When fertilizer laden water is trapped in the reservoirs and the root zone of the plant life depletes water above the reservoirs, the fertilized water will migrate upwardly to nurture the root zone.

It is important to note that the buried reservoirs or traps 20, are located at an appropriate depth below the normal or expected root zone of the plant life 25 which is to be irrigated by this underground system. The preferred burial depth of the reservoir 20, depends on the soil character such as its compactness, permeability, wetting ability and like factors which are involved in the transmission of moisture.

Moisture stored or trapped in a buried reservoir 20, as indicated in FIG. 2, vaporizes and transpires or migrates by molecular attraction through the surrounding soil 26, one soil grain at a time. As each grain is adequately covered with water, moisturization of the next grain begins. This process slowly proceeds until a bloom of moisture, indicated generally at 27 (FIG. 2), is established around each trap 20, radiating upwardly toward the soil surface 22. In average soil the noted blooming effect extends upwardly from the subterranean water source for a distance of approximately 6 to 24 inches (indicated at A in FIG. 2), or until gravity overcomes the forces of water migration.

Assuming a trap 20 is located at a depth of 24 inches below the soil surface, after a saturating rainfall or sprinkling, water will percolate downwardly through the soil and be trapped in reservoir chamber 21. Wind and sun will evaporate moisture from the surface layer of the soil to a depth of several inches or more depending on the length of time between watering or rainfalls. If there is a prolonged period between rains, moisture will be depleted from the upper layers of soil by evaporation and plants will transpire water out of the root zone until insufficient water remains to sustain plant life. However, with moisture retained in an appropriately buried reservoir trap according to this invention, the plant roots will be supplied with moisture from the reservoir's bloom area 27 to prolong the effective period of water supply and plant survival.

For effective results in using the subirrigation reservoirs hereof, reservoirs 20 preferably should be planted or buried so that the moisture bloom thereof terminates approximately 3 to 6 inches (B in FIG. 2) below the soil surface to prevent surface evaporation of the stored moisture, depending on the type and characteristics of the particular soil involved.

Figure 3:
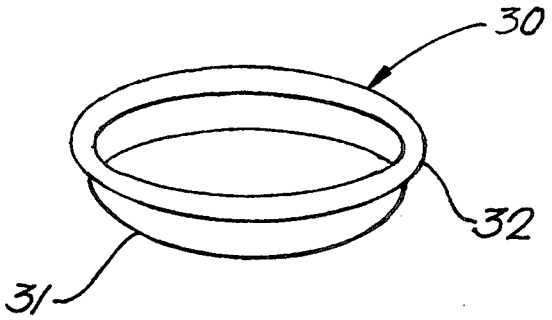
FIG. 3 is a perspective view of an optional concave cap for use with the reservoir trap of FIG. 1.
Figure 4:
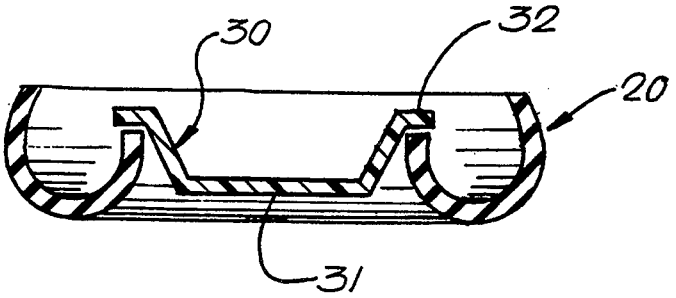
FIG. 4 is a half section view of the reservoir trap of FIG. 1 fitted with a cap of FIG. 3.

With reference now to FIG. 3 of the drawings, an optional reservoir cap 30 made of plastic or other non-degradable material is shown, comprising a central concave-convex pan portion 31 having an annular planar rim 32 extending radially outwardly of its upper edge. Such a cap is adapted to be fitted over the open center of an annular reservoir trap 20, being oriented concave side up in the manner indicated in FIG. 4 so that rim 31 rest atop the inner periphery of the annular reservoir 20. Such caps are fitted to the reservoirs when planting the latter in their subsurface positions prior to overcovering the same with earth.

Figure 5:
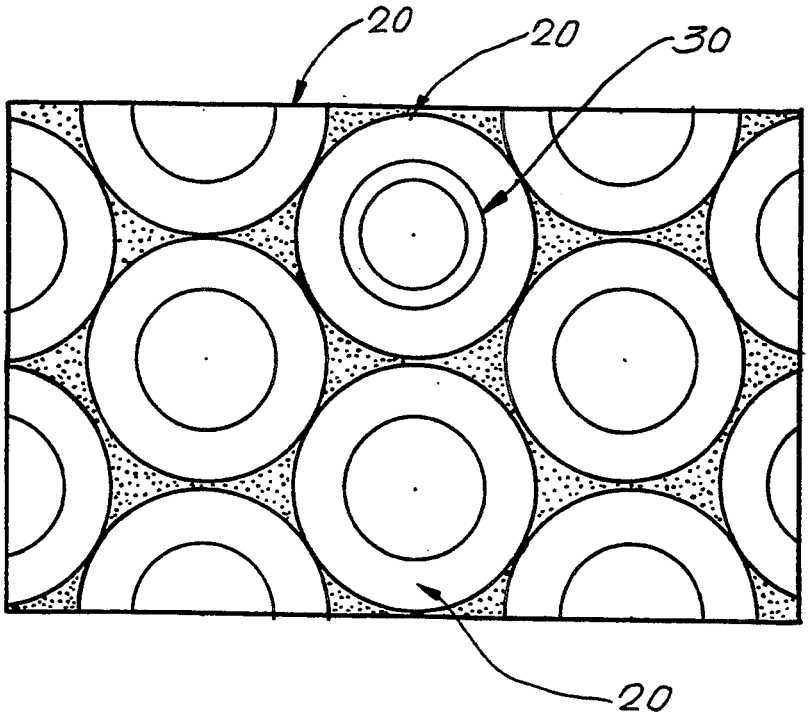
FIG. 5 is a schematic representation of a field of subsurface reservoir traps.

Typically reservoirs 20 preferably are buried in near peripheral engagement in a field in the manner schematically shown in FIG. 5 leaving the centers thereof open.

Alternatively, the open centers of the annular reservoirs may be closed by caps 30 as indicated above.

With arrangement of uncapped annular reservoirs, oriented with their concave sides up, and arranged in a single layer, as represented in FIG. 5, soil saturating rainfall will be retained by the buried reservoirs over substantially 59% of a given area. With the caps 30 installed, as above discussed, water will be trapped in the underground reservoirs over substantially 92% of the area. If double layers of same size reservoirs are employed, the water retention of the reservoirs will substantially double.

When the buried reservoirs are filled with saturated soil they will store approximately twice as much per unit volume as the soil thereabove. If split tires are utilized to provide the reservoirs hereof, almost any size tire from golf cart and passenger, truck or off-road sizes may be used. Even a smaller tire such as a 165-13 size can store sufficient water to provide extended moisture supply to crop roots.

For example a 165-13 tire has a O.D of 22½ inches and I.D. of 13 inches. When split the tire forms two reservoirs 20 each with a chamber 21 having an area of approximately 265 sq. in. Such a chamber is capable of holding 1 gallon of water which equals 0.87 inches of rainfall. When filled with soil such reservoir chamber will hold approximately 0.435 inches of water. Larger size tires of course will provide even greater storage capacity.

Figure 6:
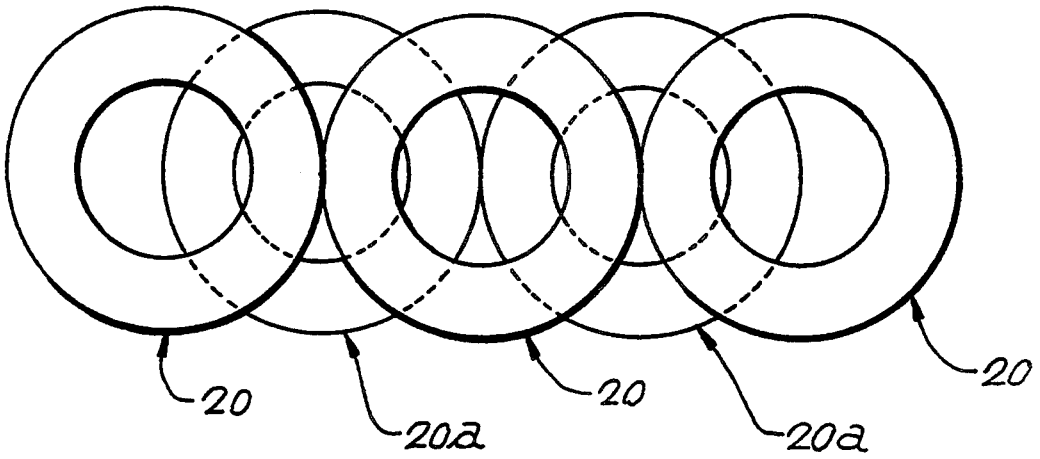
FIG. 6 is a partial plan view of an alternate arrangement of reservoir traps for increasing water retention capability.
Figure 7:
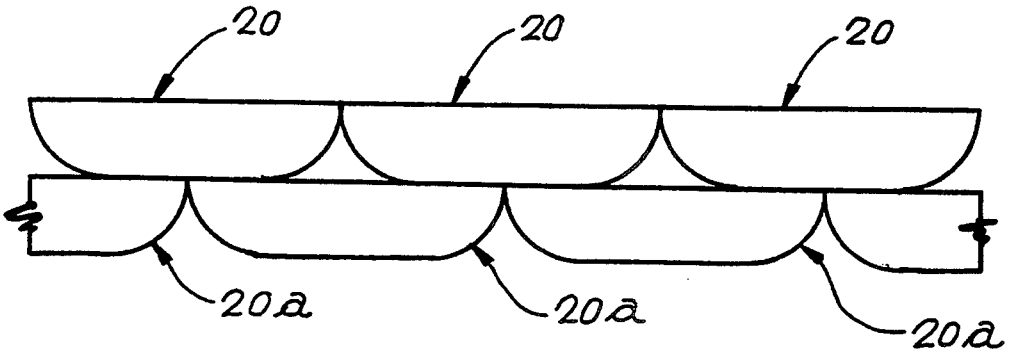
FIG. 7 is a partial front elevational view of the reservoir trap arrangement shown in FIG. 6.

With reference to FIGS. 6 and 7 of the drawings an alternate arrangement of underground reservoirs 20 is illustrated. As indicated, instead of arranging the reservoirs in a single underground layer or plane as seen in FIG. 5, multiple overlapping and staggered rows of reservoirs 20 and **20*a* may be used. This arrangement doubles reservoir capacity to the system over the open or uncapped reservoirs shown in FIG. 5. Specifically the single layer, uncapped reservoir arrangement of FIG. 5 provides approximately 59% water retention, while the double layer arrangement of FIGS. 6 and 7** afford approximately twice that water retention capacity when saturated.

Thus it will be recognized that the major objective of this invention to provide an effective and economical subirrigation system is achieved. By utilizing split or half tire carcasses for the specified annular underground reservoirs, convenient and effective disposal and reclamation of used tires is brought about. Further this system is useful with semi-productive or arid land, as well as normally crop or turf supportive acreage that requires frequent watering or irrigation such as golf courses, park properties and the like where green grass visages are desired.

From the foregoing it is believed that those skilled in the art will readily appreciate the novel advancement over the art afforded by this invention and will recognize that while this invention is hereinabove described in association with particular preferred embodiments illustrated in the drawings, the same is susceptible to variation, modification and substitution of equivalents without departing from the spirit and scope of the invention which is intended to be unlimited by the foregoing except as may appear in the following appended claims.

The embodiments of the invention in which an exclusive property or privilege is claimed are defined as follows:

1. A passive, underground irrigation system for supplying life sustaining moisture to acreage grown crops and plant life, particularly in semi-arid and marginally productive acreage generally requiring surface irrigation to sustain plant growth, comprising:

a plurality of unitary, annular, water retaining water reservoirs having non-degradable, water impervious, concave-convex walls definitive of annular concave water retention chambers fully open over one side thereof; said reservoirs being formed by dissecting discarded vehicle tire carcasses along planes normal to the central rotational axis of each thereof to produce two like reservoirs from each carcass having water retention chambers of maximum open side area and chamber capacity for a given tire size;

said reservoirs being buried underground in peripheral adjacency with said chambers thereof filled with soil and arranged in at least one generally horizontal layer spaced substantially below a planting surface and expected root zone of said plant life with the open sides of said chambers facing said root zone;

each soil filled chamber passively operating to capture and retain water that gravitates downwardly from said planting surface past said root zone and is thereby unavailable to sustain plant life;

said reservoirs being buried at a depth such that water trapped therein forms a water table located at a distance below said root zone selected so that, once said root zone is substantially water depleted, moisture will migrate upwardly from said reservoirs to said root zone but not to said planting surface, thereby preventing surface evaporation loss of moisture.

2. The combination of claim 1, wherein said plurality of reservoirs are buried in multiple horizontal layers, arranged so that the reservoirs in said layers are offset and overlap one another.

3. The system of claim 1 wherein the distance of upward water migration from said reservoir chamber is in the order of six to twenty-four inches.

4. A method of subirrigating plant life, particularly in marginally productive and semi-arid land, comprising the steps of:

severing plural discarded tire carcasses along planes normal to the rotational axis of each tire to produce multiple annular concave-convex reservoirs therefrom;

optionally cleansing said reservoirs of pollutants;

depositing said reservoirs horizontally below a planting surface with the concave side thereof facing upwardly whereby said reservoir are positioned to receive and retain moisture gravitationally percolating downwardly from said planting surface;

filling said reservoirs with soil; and burying said reservoirs at a subsurface depth spaced below the expected root zone of the plant life and approximately two feet below said planting surface to cause moisture to be trapped in said soil filled reservoirs for delayed migration therefrom upwardly to the root zone of the plant life without reaching said planting surface, once the soil above said reservoirs becomes depleted of moisture.

5. The method of claim 4, wherein said reservoirs are buried in peripheral adjacency to form a generally horizontal layer of reservoirs.

6. The method of claim 4, wherein said reservoirs are buried in multiple generally horizontal layers, with the reservoirs of said layers offset and overlapping one another.

* * * * *